United States Patent [19]

Saupe

[11] 3,952,696

[45] Apr. 27, 1976

[54] FIXING DEVICE FOR ELECTROPHOTOGRAPHIC COPYING APPARATUS

[75] Inventor: Wolfram Saupe, Mammolshain, Germany

[73] Assignee: Hoechst Aktiengesellschaft, Frankfurt am Main, Germany

[22] Filed: July 24, 1974

[21] Appl. No.: 491,350

[52] U.S. Cl. ..... 118/60; 118/101; 432/60; 432/228

[51] Int. Cl.[2] ..... G03G 15/20

[58] Field of Search ..... 118/60, 101, 637; 432/60, 228; 29/132

[56] References Cited

UNITED STATES PATENTS

| | | | |
|---|---|---|---|
| 2,870,312 | 1/1959 | Westervelt | 432/228 |
| 3,268,351 | 8/1966 | Van Dorn | 118/60 |
| 3,666,247 | 5/1972 | Banks | 118/60 |
| 3,716,221 | 2/1973 | Gorka et al. | 118/60 |
| 3,745,972 | 7/1973 | Thettu | 118/60 |

*Primary Examiner*—Mervin Stein
*Assistant Examiner*—Douglas Salser
*Attorney, Agent, or Firm*—Bacon & Thomas

[57] ABSTRACT

Electrophotographic copying apparatus is disclosed including electrically heatable contact fixing means for fixing an electrophotographically produced toner image on an image carrier. The fixing means includes an electroconductive fixing layer mounted in insulated relation upon a continuously moving web which, in the preferred embodiment, comprises a cylindrical member. Heating electrical energy is supplied to said electroconductive fixing layer via contact cap means which are mounted on the ends of the cylinder member and which engage the free edges of the electroconductive layer throughout the length thereof, respectively, and stationary sintered bearing means that are electrically connectd both with the contact means and with the source of electrical energy. Pressing means extend partially around the circumference of the cylindrical member in pressure engagement with the fixing surface, said pressing means exerting a sliding frictional force on the non-image side of the image carrier which is lesser than the static frictional force between the heatable fixing layer and the image side of the carrier. Preferably the pressing surface of the pressing means is formed of polytetraflouroethylene.

15 Claims, 3 Drawing Figures

FIXING DEVICE FOR ELECTROPHOTOGRAPHIC COPYING APPARATUS

FIELD OF THE INVENTION

This invention relates to electrophotographic copying apparatus having contact fixing means for heating, and possibly fusing, electrophtographically produced toner images on an image carrier.

BACKGROUND OF THE INVENTION

One of the major problems in electrophotographic copying apparatus, and in particular copying apparatus in which dry thermoplastic toner is used, is the fixing of the toner images on the paper. A large number of processes and devices for fixing toner images by means of heat have already been proposed. These fixing devices may be divided into three main types. The first process is known as radiation fixing. In this process, the toner image is heated by the absorption of irradiated energy, and is thereby fixed on the paper. This process requires considerable energy and has the additional disadvantage that, when a radiation process alone is used, the adhesion between the toner particles and the paper fibers cannot be improved. The second process consists of fixing by hot air. The difficulties arising in this process are mainly those of soiling of the apparatus, and the problem of bringing hot air into contact with the toner image in a definite manner. Finally, the third process is known as contact fixing. In this process, a heated surface is brought into contact with the toner image.

From the point of view of consumption of energy and technical expenditure, contact fixing is the most favorable process, but this process also entails serious problems. Firstly, in contact fixing there is the problem of toner particles being deposited in the form of an image on the fixing surface and being transferred onto the next copy. This so-called offset-effect, which gives rise to "ghost images", is extremely troublesome. To alleviate this problem it has been proposed to provide a fixing roller surface with polytetrafluoroethylene covered with a thin film of silicone oil. While this contact fixing device has proven to be the most successful so far, certain problems do occur. Firstly there are difficulties in achieving even temperature distribution over the length of the roller. The distribution is frequently nonuniform in practice, so that the fixing quality and the wipe strength of the copies obtained are unsatisfactory in many places. In addition a considerable expenditure of energy is still necessary for heating the roller if there is provided on the inside of the roller a heating element the temperature of which lies considerably above the temperature on the outer surface of the roller necessary for fixing.

It has also already been proposed to provide on the inside of the roller, instead of a conventional heating device, an electrical resistance heating device under the polytetrafluoroethylene layer, and if necessary to use this in conjunction with a radiation heat source. These improvements, however, still require a considerable technical expenditure.

There is accordingly a need for a contact fixing device which combines as uniform as possible a temperature over the entire width of the contact fixing surface with as small as possible an energy consumption, and in which the heating element is operated at as low a temperature as possible.

SUMMARY OF THE INVENTION

The present invention relates to electrophotographic copying apparatus including a contact fixing device for fixing an electrophotographically produced toner image on an image carrier, which device comprises a heatable contact surface for contacting the toner image, which contact surface forms at least part of the outer surface of a continuous revolvable web. More particularly, the contact surface comprises an electroconductive fixing layer mounted on an electrically insulative layer, the web being provided along substantially the whole length of each of its edges with contact means for connecting a source of electrical energy with the conductive fixing layer, thereby to uniformly heat the same.

The electroconductive fixing layer is preferably formed of rubber (natural or synthetic) having conductive particles dispersed therein, e.g., as a suitable rubber, the fixing layer may comprise silicone rubber having a thickness of from about 0.5 to 5 mm (preferably 0.5 mm) and a specific resistance of from about 4 to 40 ohm-cm (preferably about 4.5 ohm-cm).

The revolvable web conveniently takes the form of a cylindrical member arranged for rotation about its longitudinal axis; the circumferential surface of the cylindrical member then comprises the means for supporting in an insulated manner the electroconductive contact surface.

Electrical contact to the conductive surface is made, in a preferred embodiment, by means of contact caps arranged to rotate with the cylindrical member, said contact caps being provided at each end of the cylindrical member, respectively, to contact the conductive layer along the whole of each of its peripheral edges. Each contact cap is in continuous electric contact with a slide bearing, preferably a sintered bearing, which does not rotate with the roller, and to which a source of electricity, preferably alternating current energy at 20 to 220 volts, is connected.

It has already been proposed to improve the efficiency and the energy consumption of an existing contact fixing device by enlarging the contact region between the image carrier and the fixing roller in roller-type fixing devices by replacing the conventionally used counter-roller by a co-revolving belt. This proposal has two serious disadvantages. Firstly, it is structurally complex and therefore expensive, and second the use of a revolving belt means that there is a considerable loss of heat since the belt on the rear side of the image carrier further from the heating roller is cooled down considerably and thus causes an additional energy loss.

This secondary problem may be alleviated according to the invention, which further provides electrophotographic copying apparatus including a contact fixing device for fixing an electrophotographically produced toner image on an image carrier, which device comprises a cylindrical member mounted for rotation about its longitudinal axis, at least part of the circumferential surface of the cylindrical member being heatable for use as a fixing surface. The apparatus further includes a pressing means of a width at least equal to that of the fixing surface of the cylindrical member, which pressure surface is arranged so as partially to surround the cylindrical member and to exert pressure on its fixing layer, the materials of the electroconductive layer and of the image carrier being so chosen that when the image carrier is positioned between the web and the cylinder, the pressure surface coming into contact with the rear, non-image side of the carrier exerts a sliding frictional force thereon which is smaller than the static frictional force between the fixing layer of the cylinder and the front, image side of the carrier.

It is preferred that at least that part of the pressure surface which comes into contact with the rear, non-image side of the image carrier consists of electrically insulating material.

It has surprisingly been found that when the fixing means has an electroconductive surface consisting of conductive silicone rubber, which has a certain sensitivity to pressure in continuous operation, the use of a web or mat, of which at least the surface coming into contact with the cylindrical member or with the rear, non-image side of the image carrier consists of polytetrafluoroethylene, allows for reliable fixing of the toner image without the toner image being displaced or destroyed, and without the silicone rubber layer being noticeably stressed mechanically. The pressing means is suitably made of polytetrafluoroethylene fabric, felt or fleece.

In a preferred embodiment the pressing means is secured by means of a tension element, for example a spring, the tension of which determines the force with which the pressing means presses against the fixing cylinder.

Preferably, the contact fixing is combined with a temperature measurement of the cylinder surface, so that this temperature measurement can be used to regulate the surface temperature of the cylinder. This can be effected either directly by means of either contacting or non-contacting temperature-measuring elements, or indirectly by measuring the resistance of the conductive silicone rubber layer.

The invention will now be explained in further detail, by way of example only, with reference to the accompanying drawings, in which.

DETAILED DESCRIPTION OF THE INVENTION

Figure 1:
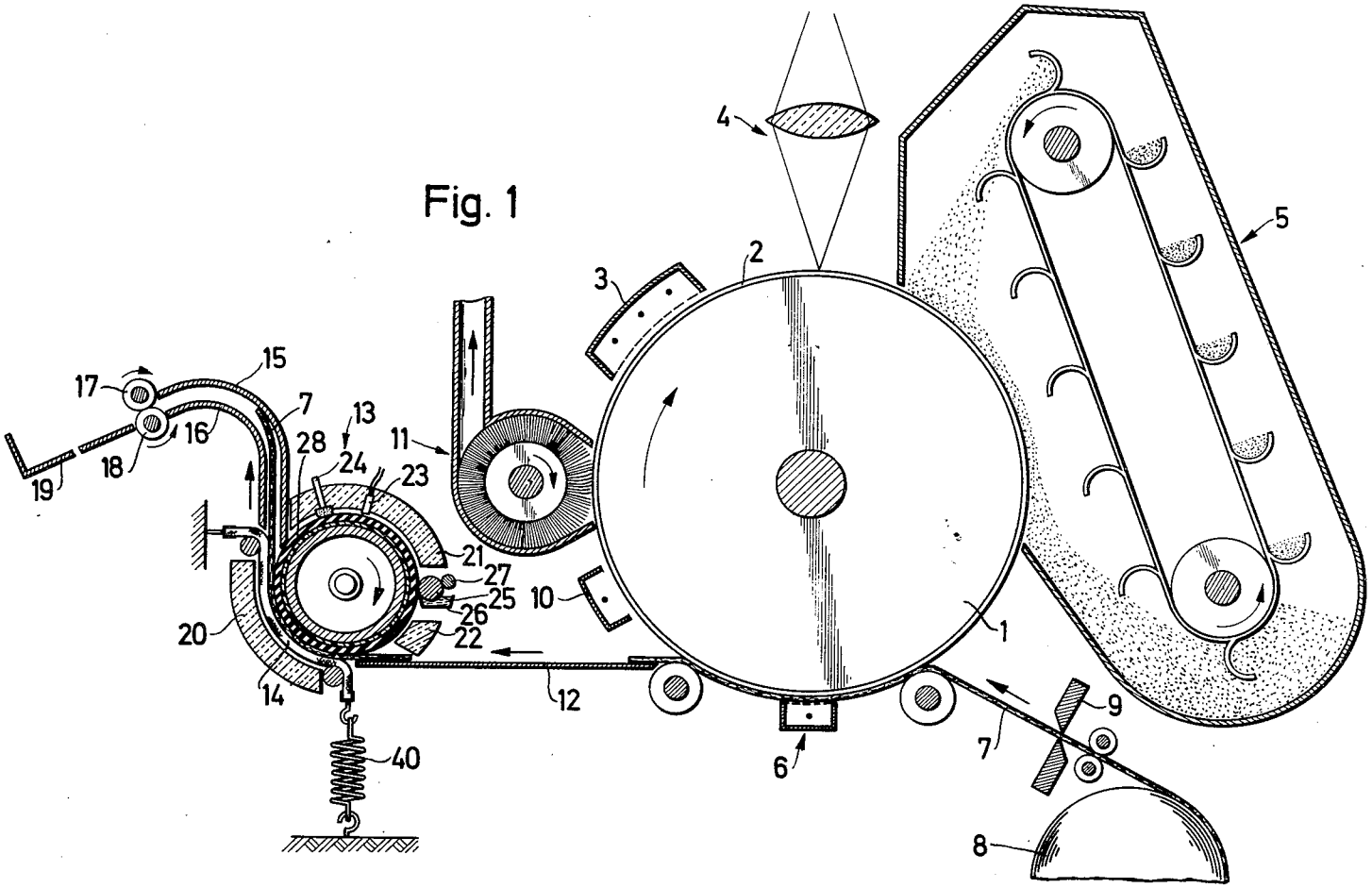
FIG. 1 is a schematic representation of an electrophotographic copying apparatus including fixing means according to the present invention.

Referring now to FIG. 1, a photoconductor 2 arranged on a drum 1 is uniformly charged in a charging station 3 (e.g., by means of a corona discharge device). In an exposure station 4, the uniformly charged photoconductor 2 is exposed. The resulting latent charge image on the photoconductor is developed in a cascade developing station 5, and the toner image disposed on the photoconductor is transferred in a transfer station 6 onto a carrier 7 of suitable material (e.g., paper) drawn from a supply roller 8 and cut off by a cutting device 9 in the desired format. Toner remaining on the photoconductor 2 is removed by means of a cleaning corona 10 and a brush cleaning station 11. The described cycle may now be repeated.

The sheet of paper 7 passes over a plate 12 into the gap between a contact fixing cylinder 13, which will be described in more detail below, and a web 14 of polytetrafluoroethylene gauze, felt or fabric. After fixing, the copy 7 passes between guide plates 15 and 16 and between a pair of rotating rollers 17, 18 to a copy-receiving container 19.

Arranged around the fixing cylinder 13 is a heat insulating material 20, 21 and 22 to keep the loss of energy as low as possible. By means of a temperature-measuring device 23, the surface temperature of the fixing cylinder may be measured and the values taken used to regulate the temperature. By means of a cleaning device 24, the surface of the fixing cylinder is freed of any toner adhering to it. By means of a wetting roller 25, silicone oil from a container 26 is applied to the fixing cylinder to facilitate cleaning adhering toner from the fixing cylinder. Working together with the wetting roller is a squeezing roller 27; the force with which the roller 27 presses on the wetting roller 25 is adjustable.

Figure 2:
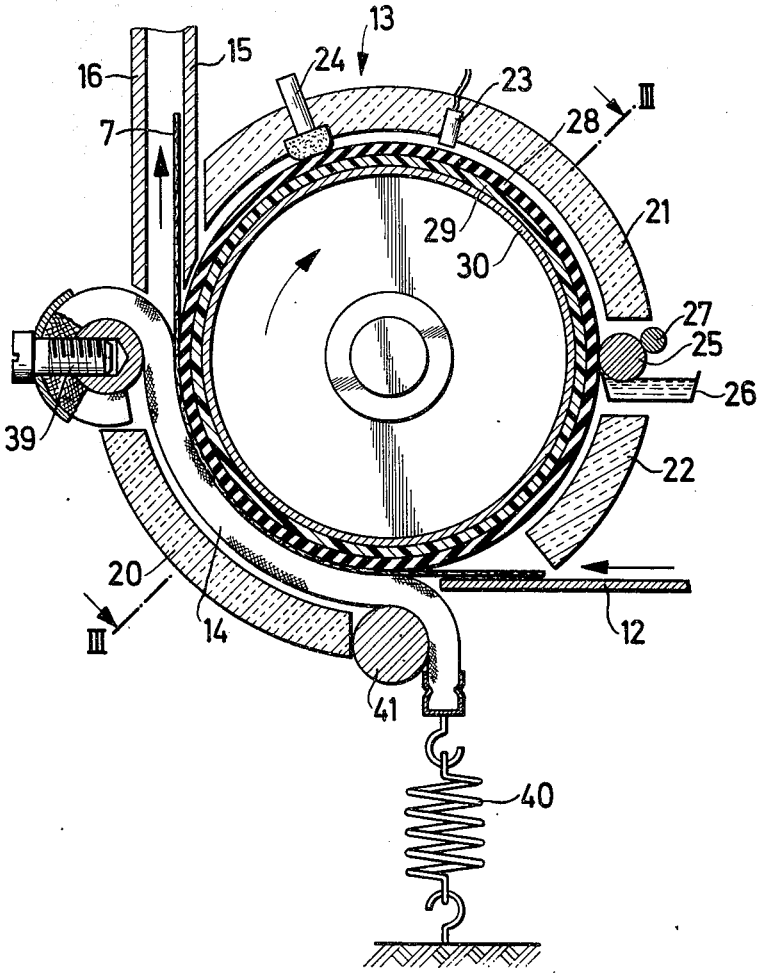
FIG. 2 is an enlarged cross-sectional view of the fixing means of FIG. 1.
Figure 3:
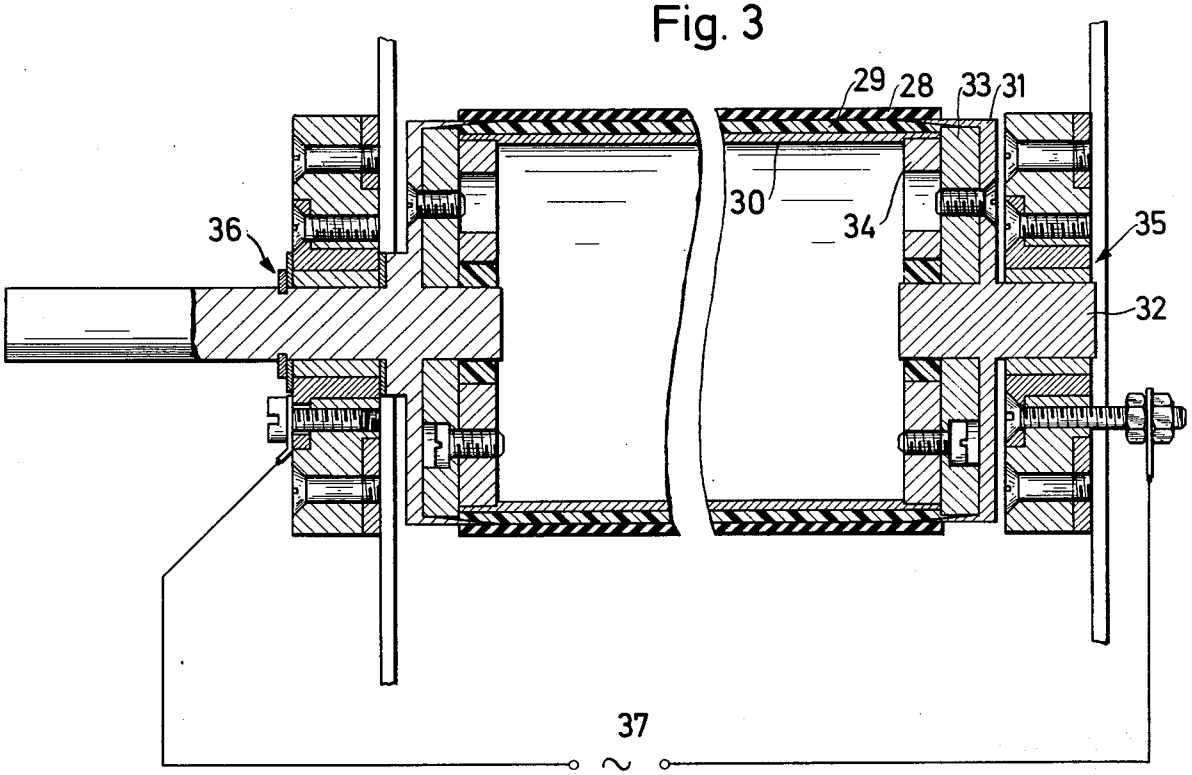
FIG. 3 is a longitudinal sectional view of the apparatus of FIG. 2.

For a more detailed description of the fixing device, reference is made to FIGS. 2 and 3. The copy 7 passes during the fixing stage between the outer surface of the fixing cylinder 13 and the mat 14 of polytetrafluoroethylene material. The fixing cylinder 13 has a layer of conductive silicone rubber 28. This silicone rubber is, for example, the produce "R770 $VC_2$" of Messrs. Wacker-Chemie GmbH, Munich, Germany. This product has a density of 1.2 g/cm$^3$ (DIN 53550), a Shore hardness of 70 (DIN 53505), tensile strength of 60 kp/cm$^2$ (DIN 53504/Form III), an elongation at break of 200% (DIN 53504/Form III), a tear propagation resistance of 12 kp/cm$^2$ (ASTM D 624/Form B), a rebound elasticity of 35% (DIN 53512), a compression strain remainder of 20% (20 hours at 175° C, DIN 53517) and a specific resistance of from about 4 to 40 ohm-cm, preferably 4.5 ohm-cm (VDE 0303/Part 3). The thickness of the conductive layer of silicone rubber is from about 0.5 to 5 mm (preferably 0.5 mm) and the alternating-current voltage to be applied is preferably from about 20 to 220 volts. In this manner cylinder surface temperatures of 100° to 200° C are achieved. It has been proven that the temperature distribution on the cylinder surface is substantially more uniform than in other fixing systems with only a virtually negligible loss of heat via the cylinder bearings.

The fixing cylinder 13 includes a tubular metal member 30 upon which are concentrically mounted a layer of insulating material 29 and the silicone rubber layer 28, whereby the silicone rubber layer is electrically insulated from the tubular layer. The means for supplying electrical energy to the silicone layer 28 include a pair of contact caps 31 arranged at opposite ends of the fixing cylinder, each of said contact caps including an annular flange portion that extends inwardly between the layers of silicone rubber and insulating material, whereby each of the contact caps is in electrical engagement with the silicone rubber layer 28 throughout substantially the entire length thereof, thereby assuring a good and reliable electrical contact.

The contact caps 31 have stub shafts 32 and are secured to an insulating plate 33 (preferably formed of polytetrafluoroethylene). This insulating plate 33 is bolted in turn by means of an annular disc 34 which is soldered to the metal tube 30. This arrangement ensures that the contact caps 31 are electrically insulated from and are not short-circuited by the tube 30. Mounting of the fixing cylinder is effected by means of two electrically-conductive sleeve bearings 35, 36 (e.g., sintered bearings), through which electric current may flow via the contact caps to the silicone rubber layer from the alternating-current voltage source 37. Preferably the voltage of the source 37 is from about 20 to 220 volts.

To produce copies of satisfactory quality it is necessary that the fixing cylinder 13 have a smooth, unflawed outer surface. The silicone rubber layer on the outer surface of the cylinder is milled for this purpose.

In the described construction, the heat loss is reduced to a minimum by the use of insulation. The heating element and the contact element are one and the same, i.e., the heat is produced directly at the same place as it is consumed, so that there is no need for a heat source having a higher temperature than the surface temperature of the fixing cylinder. The copy is guided along the rotating fixing cylinder 13 by means of a mat 14 of polytetrafluoroethylene felt or gauze fabric securely installed in the apparatus. The material for this mat is chosen so that the sliding friction force exerted on the rear side of the copy 7 by the mat is less than the force necessary to release the front side of the copy 7 from the fixing roller. The mat 14 is securely fixed at one end in the apparatus by a screw-clamp joint 39 (FIG. 2). The free end of the mat is under the constant tension of a spring 40. The mat may be guided around the roller by means of a rod 41 but it is preferable to secure it by means of a tension element, e.g., a spring. This spring 40 exerts only a small tension on the mat so that the latter presses gently against the fixing cylinder. In this manner, although good contact between the fixing cylinder and the toner image is achieved, undesirable mechanical stress and deformation of the fixing cylinder is avoided.

In the alternative, instead of the conductive contact layer 28 being formed of silicone rubber, it could consist of a rubber-like material (such as natural or synthetic rubber) having electrically conductive particles dispersed therein. Other modifications may be made in the apparatus described without deviating from the inventive concepts.

What is claimed is:

1. Contact fixing means adapted for use in an electrophotographic apparatus to fix an electrophotographically produced toner image on an image carrier, comprising a. a web member adapted for continuous movement;

b. a continuous fixing layer of electrodonductive material comprising silicone rubber operable to define a heatable contact surface;

c. insulating means for mounting said electroconductive layer in electrically insulated relation on said web member; and d. means for connecting said electroconductive fixing layer with a source of electrical energy, thereby to heat said fixing layer, said connecting means including a pair of contact means engaging the edges of said fixing layer, respectively, throughout substantially the entire length thereof.

2. Apparatus as defined in claim 1, wherein said silicone rubber fixing layer has a thickness of from about 0.5 to 5 mm.

3. Apparatus as defined in claim 1, wherein said silicone rubber fixing layer has a specific resistance of from about 4 to 40 ohm-centimeter.

4. Apparatus as defined in claim 1, wherein said web member comprises the circumferential surface of a cylindrical member adapted for rotation about its longitudinal axis.

5. Apparatus as defined in claim 4, wherein each said contact means comprises a contact cap, and further including means for mounting said contact cap in insulated relation on one end of said cylindrical member, said contact cap including an angular flange portion extending inwardly between said electroconductive fixing layer and said insulating means, said flange being in continuous electrical engagement with the adjacent edge of said electrocondictuve fixing layer throughout substantially the entire length thereof.

6. Apparatus as defined in claim 5, and further including means supporting said cylindrical member for rotation about its longitudinal axis, said supporting means including stationary bearing means insulated from said cylindrical member, said bearing means being in continuous electrical engagement with said contact cap and comprising a portion of said connecting means for connecting said electroconductive fixing layer with the source of electrical energy.

7. Apparatus as defined in claim 5, wherein said bearing means comprise sintered slide bearings.

8. Electrophotographic copying apparatus including contact fixing means for fixing an electrophotographically produced toner image upon an image carrier, comprising a. a cylindrical member mounted for rotation about its longitudinal axis;

b. means defining on the circumferential surface of said cylindrical member a heatable fixing layer; and c. means for pressing said image carrier against said circumferential surface comprising a web extending partially around the circumference of said cylindrical member and being movable against said cylindrical member for defining a pressure surface in pressure engagement with said fixing surface, the width of said pressing means being at least as great as that of said fixing surface;

d. said heatable fixing layer, said carrier and said web being formed of such materials that when the image carrier is positioned between the web and the roller with the image side of the carrier facing said fixing layer, the pressure surface engaging the rear non-image side of the carrier exerts a sliding frictional force thereon which is less than the static frictional force between said fixing layer and the front image side of the carrier.

9. Apparatus as defined in claim 8, wherein at least that part of the pressure surface of said pressing means which comes into contact with the rear non-image side of the image carrier consists of electrically insulating material.

10. Apparatus as defined in claim 9, wherein the fixing layer on said cylindrical member consists of electroconductive silicone rubber, and wherein the pressure surface of said pressing means comprises polytetrafluoroethylene.

11. Apparatus as defined in claim 10, further including spring means attached to one end of said pressing means for determining the pressure exerted on said fixing layer by said pressure surface.

12. Apparatus as defined in claim 8, wherein said cylindrical member is of an electrically conductive material and further comprising a layer of electrically insulating material between said cylindrical member and said circumferential heatable fixing layer, said fixing layer comprising an electroconductive material.

13. Apparatus as defined in claim 12, further including means for connecting said electroconductive fixing layer with a source of electrical energy, said connecting means including a pair of means for contacting the edges of said fixing layer, each of said contacting means comprising a contact cap and means for mounting said contact cap in insulated relation on one end of said cylindrical member, said contact cap including an angular flange portion extending inwardly between said electroconductive fixing layer and said insulating layer, said flange being in continuous electrical engagement with the adjacent edge of said electroconductive fixing layer throughout substantially the entire length thereof.

14. Apparatus as defined in claim 13, further including means supporting said cylindrical member for rotation about its longitudinal axis, said supporting means including stationary bearing means insulated from said cylindrical member, said bearing means being in continuous electrical engagement with said contact cap and comprising a portion of said connecting means for connecting said electroconductive fixing layer with the source of electrical energy.

15. Apparatus as defined in claim 14, wherein said bearing means comprise sintered slide bearings.

* * * * *